US006868366B1

(12) United States Patent
Eisenzopf

(10) Patent No.: US 6,868,366 B1
(45) Date of Patent: Mar. 15, 2005

(54) METHOD FOR MEASURING PIPING FORCES ACTING ON A TURBINE CASING

(75) Inventor: Peter John Eisenzopf, Altamont, NY (US)

(73) Assignee: General Electric Company, Schenectady, NY (US)

( * ) Notice: Subject to any disclaimer, the term of this patent is extended or adjusted under 35 U.S.C. 154(b) by 15 days.

(21) Appl. No.: 10/662,321

(22) Filed: Sep. 16, 2003

(51) Int. Cl.[7] ..... F01B 25/26; F04D 29/00

(52) U.S. Cl. ..... 702/182; 702/33; 702/42; 415/118

(58) Field of Search ..... 702/33, 35, 41, 702/42, 43, 11.3, 11.5, 127, 150, 158, 166, 168, 170, 172, 182–184; 33/531, 613, 542; 73/116, 168; 415/1, 13, 14, 118; 60/803

(56) References Cited

U.S. PATENT DOCUMENTS 5,374,068 A 12/1994 Jewett et al. ..... 277/303
5,509,780 A 4/1996 Synfelt ..... 415/174.1
5,605,438 A 2/1997 Burdgick et al. ..... 415/182
6,257,829 B1 7/2001 Seeley et al. ..... 415/213.1
6,594,555 B2 7/2003 Steingraeber ..... 700/279
6,665,589 B2 12/2003 Steingraeber ..... 700/279
2002/0197147 A1 * 12/2002 Kawai et al. ..... 415/1

* cited by examiner

*Primary Examiner*—Marc S. Hoff
*Assistant Examiner*—Manuel L Barbee
(74) *Attorney, Agent, or Firm*—Nixon & Vanderhye P.C.

(57) ABSTRACT

A method is disclosed to monitor deflections in a turbine casing by: positioning gap sensors on a shell standard support surface and below an opposite surface of the shell arm support; each gap sensor monitoring a gap between the shell standard support surface and shell arm support; determining change in the planar slope of the shell arm support over the period of time based on the collected data, wherein changes in the slope indicate deflections in the casing.

19 Claims, 3 Drawing Sheets

METHOD FOR MEASURING PIPING FORCES ACTING ON A TURBINE CASING

BACKGROUND OF THE INVENTION

The present invention relates to the detection of pipe load changes on steam turbine casings during turbine assembly and start-up and shutdown transients.

During turbine startup, the reactive loads on the casing vary as steam flow through connected pipes causes the pipes to thermally expand or contract. These load variations can cause the casing to deflect and translate (collectively referred to as "deflections"). Deflection of the turbine casing can result in seal damage as radial rubbing steam seal rubbing increases steam leakage flow and reduces turbine efficiency.

Seals within a steam turbine generally include teeth on the stationary components which interlace with lands on the rotor-bore and bucket covers. The radial gaps between the stationary and rotating sealing features are designed as narrow as possible to minimize steam leakage. Deflection of the casing can result in rotating parts coming into contact with the stationary seals. Contact between rotating parts and stationary seals damages the seals and results in increased steam leakage.

Excessive force on the casing due to pipe connections can occur during the assembly or operation of a turbine. Excessive cold forces on the turbine casing can result if recommended installation procedures are not followed during assembly of the steam turbine. Excessive and varying forces on the turbine casing can develop during turbine startup and shutdown transients due to thermal expansion of the piping system and the steam turbine. The differential expansions between the pipes and casing apply forces, moments and torques on the casing that deflect and translate the casing shells.

Excessive piping loads can also deflect and translate the turbine casing during turbine transient operations. Piping loads during transients, if sufficiently large, can result in a loss of radial clearance control between the rotating parts, e.g., bucket covers, and the stationary seals. A consequence of the loss of radial clearance control is that rubbing may occur between the rotating parts and stationary seals. Radial rubbing will increase steam leakage through the seals. Accordingly, excessive pipe loads may damage the seals between the rotating and stationary parts such that turbine performance is degraded.

Current methods for measuring forces, moments and torques imparted by interconnecting pipes on turbine casings are often inaccurate and expensive to execute. For example, strain gage systems installed on individual pipes connected to a casing have limited accuracy and precision. The raw strain gage signals generally require correction factors for: temperature, moisture, pressure changes, non-uniform pipe cross sections, torsion and other factors. Furthermore, strain gages measure the forces imparted by individual pipes on a turbine casing and do not directly measure the deflection of a casing. The deflection of the casing is often due to multiple piping forces that deform the casing in a non-linear fashion. Complicated analyses must be performed to derive the deflection of the turbine casing from the individual strain gage measurements.

There is a long felt need for techniques to measure accurately the deflection of a turbine casing due to forces, moments and torques imparted by interconnecting pipes on the casing. Such a technique is needed to validate that the pipes do not apply excessive forces, moments and torques on the turbine casing, during turbine assembly as well as startup and shutdown transients. Such a technique is also needed to identify the occurrence of excessive piping forces. Corrective action may be taken once these excessive piping forces are identified. The desired technique should detect when excessive piping forces and moments of torque are being applied to the turbine casing which may result in a loss of radial clearance control between the rotating parts and stationary seals in a turbine.

BRIEF DESCRIPTION OF THE INVENTION

In a first embodiment, the invention is a method to monitor deflections in a turbine casing by monitoring changes in reactions at each of the shell supports. The invention consists of: three sensitive gap measuring sensors positioned under each shell arm on opposite sides of each shell arm key support; each gap sensor monitoring changes in the gap between the probe and the underside of the shell arm support; collecting continuous data regarding all gap measurements for each of the support arms; using the gap change data to determine changes in the planar slope of the underside of each shell arm, wherein the changes in the planar slope of all shell arm supports is indicative of the deflection of the casing.

DETAILED DESCRIPTION OF THE INVENTION

A technique has been developed to measure accurately, reliably, and at a relatively low cost changes in the deflection of a turbine casing. The technique is particularly useful to monitor casing deflections, e.g., casing distortions and translations, due to changes in the forces, moments and torques applied by interconnected piping to the casing. The deflection of the turbine shell due to reaction forces from piping and other force sources is monitored by measuring changes in the slope of each shell arm support using sensitive gap measuring instruments. Monitoring and measuring changes in the gap between the shell arm and shell standard support is an inexpensive and reliable technique to monitor casing deflection and piping loads applied to the casing.

The gap changes to be measured exist between probes mounted on the shell standard supports and the underside of each shell arm support. Measuring the gap changes at two locations on one side of the key and one location on the opposite side of the key provides information regarding changes in the planar slope of the underside of the shell arm support. Changes in the slope of the shell arm surface indicate how the casing is being deformed by piping forces, moments and torques.

The measured changes in shell arm slope also provide information which can be used to identify the specific pipe which is causing the casing deflection. Plotting the changes in shell arm planar slope over the course of time displays information regarding changes over time in the forces, moments and torques applied to a casing due to interconnected piping.

The technique disclosed here need not measure piping forces or loads directly. Instead, the technique may measure the resultant deflection of the casing shells at the shell arms. The relative deflection of the shell arms is indicative of the sum of all forces, moments and torques applied by the interconnected pipes attached to the casing. Accordingly, a determination may be made of the interconnection piping forces, moments and torques on turbine shells by monitoring changes in the gap between the shell arms and the shell standard supports.

Figure 1:
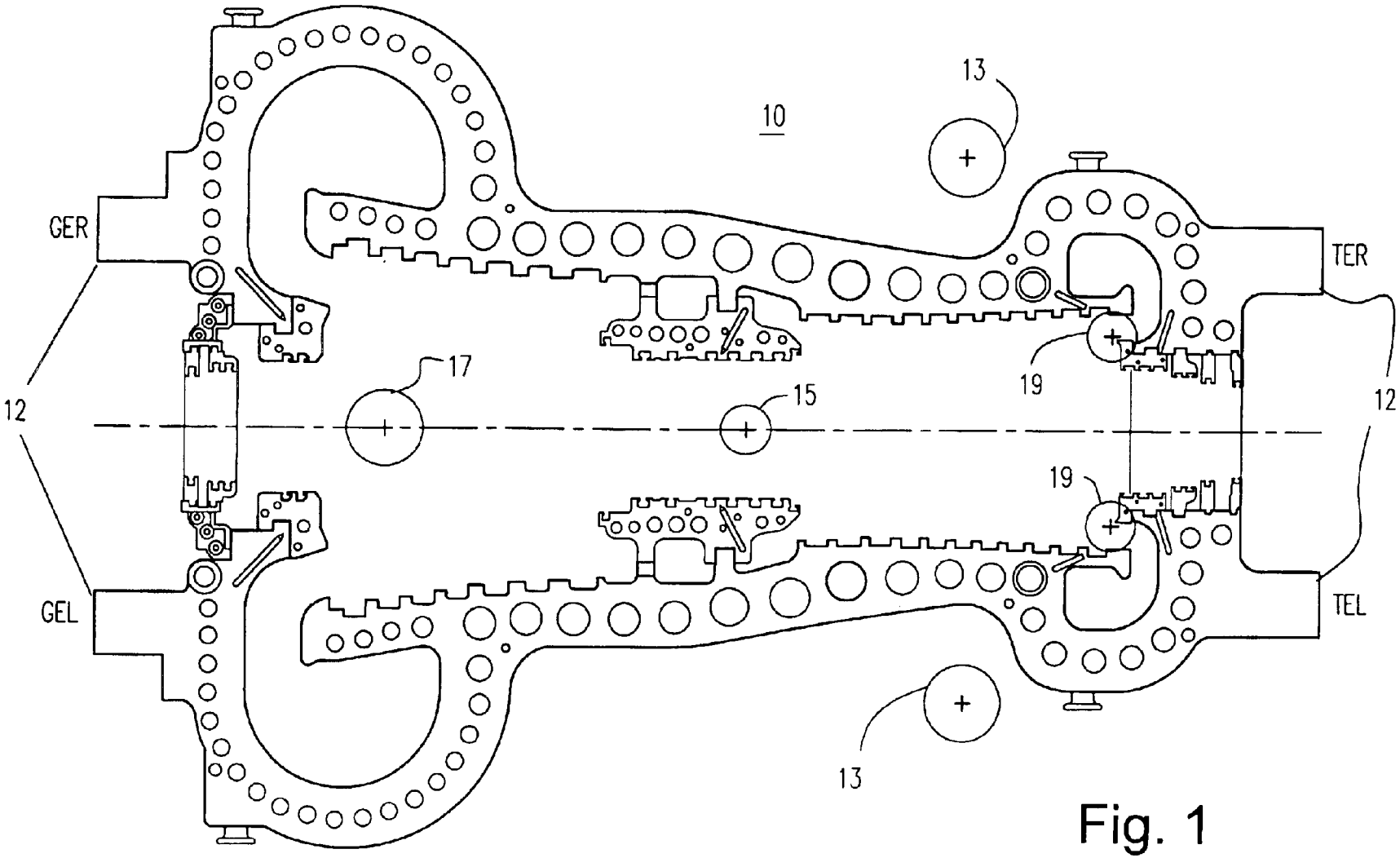
FIG. 1 is a diagram of a half-section of a steam turbine casing.

FIG. 1 shows in cross-section an exemplary design of a steam turbine casing 10. The casing includes shell arm supports 12 (See FIG. 2) which are each supported by a key 22 and a shell standard support 14. Each shell includes four support arms 12 (GER=Generator End Right, GEL=Generator End Left, TER=Turbine End Right, TEL=Turbine End Left). The key 22 transmits vertical loads from the shell arm supports 12 to the shell standard supports 14 through surfaces 26 and 24 respectively. The key also transmits axial loads from the shell arm supports 12 to the shell standard supports 14 through side surfaces 20. The steam pipes that connect to the casing include the hot reheat steam pipes 13, the main steam pipe 15, the low-pressure steam admission pipe 17, and the cold reheat steam pipes 19.

Figure 3:
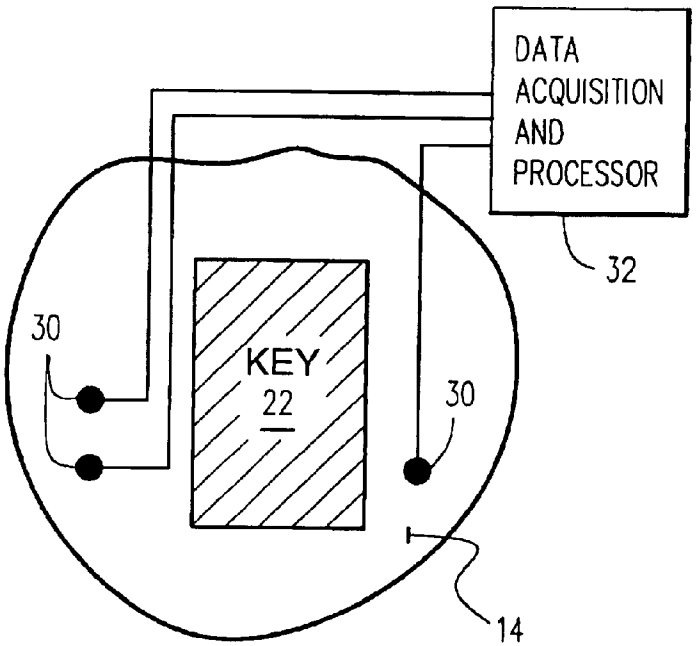
FIG. 3 is an enlarged plan view of the shell arm gap change monitoring instrumentation located on both sides of the key to provide planar slope change information.
Figure 2:
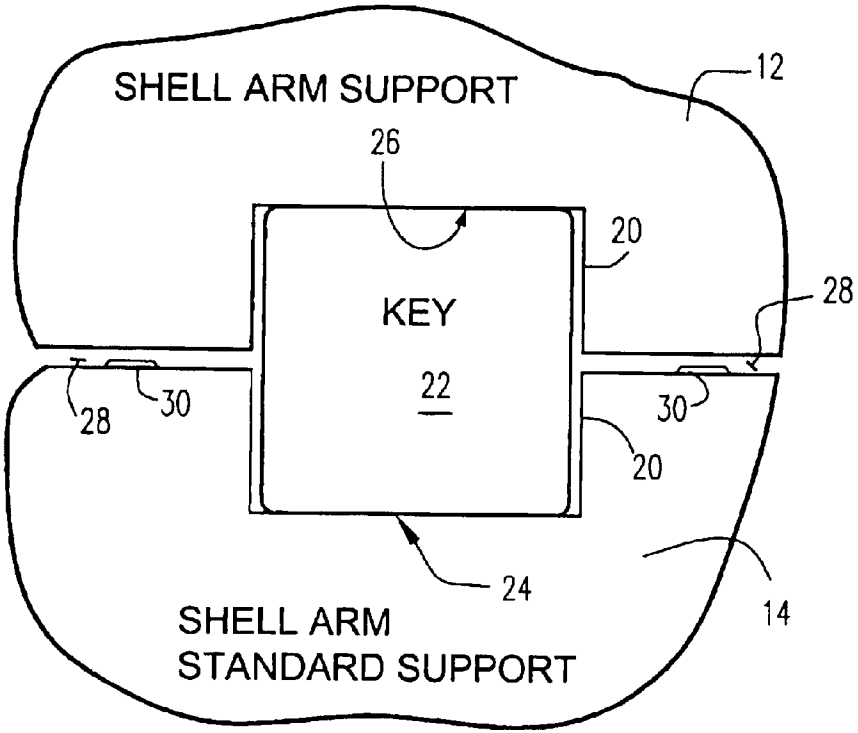
FIG. 2 is an area enlarged side view of a shell arm support structure which consists of a shell arm, a key, and a shell standard support. Probes for monitoring shell arm gap changes on either side of the key are mounted on the standard support.

FIG. 2 is a side schematic view of a portion of the support arms and key. FIG. 3 is a top-down view of a schematic of a shell arm standard support 14. Each shell arm standard support 14 has a key slot 20 that when aligned allows insertion of a rectangular key 22. The key rests on a lower surface 24 of the slot in the shell standard support 14. The upper surface 26 of the key 22 provides a support for the shell arm 12. The key height is designed to produce a small gap 28 between the shell arm support and the shell standard support. This gap is approximately 0.20 to 0.25 inch (0.508 to 0.635 cm).

Non-contact gap measuring probes 30, such as capacitance probes, placed in the gap 28 provide sensitive measurements of gap changes between the probe and the underside of the shell arm support on a continuous basis. Three non-contact gap measuring probes 30 may be positioned in the gap 28 on the surface of the shell standard support 14 with two probes on one side of the key and one probe on the opposite side. The gap measuring probes 30 are placed at known distances from each other and may be arranged about the shell arm key 22. Three probes in the gap between shell arms provide sufficient data to determine the planar slope changes. Where only axial slope change data is needed, a two probe setup where the probes are installed on opposite sides of the key can be used.

Prior to the first startup of the turbine, the ambient temperature of the turbine unit is measured and recorded. In addition, the three calibrated non-contact gap measuring probes 30 are inserted in the gap 28. Two probes may be arranged on one side of the key 22 and the other probe on an opposite side of the key. The three probes define a plane associated with the gap 28. Initial readings from the three probes are used to establish the baseline slope of the shell arm support. This baseline slope serves as the basis for all future measurements so that both the magnitude and direction of slope change can be continuously monitored.

The probes are connected to a data acquisition unit 32, such as a computer controller for the steam turbine. During operation of the turbine, including startup, steady-state, load changes, shut-down, and turbine post-shutdown cool down the gap measuring probes 30 each sense changes in the width of the gap 28. Data from the sensors is collected, time stamped and stored in an electronic memory of the data acquisition unit. The time and gap data is stored and is available to the controller for subsequent determinations of gap width changes. The data provides accurate absolute information regarding the dimension, e.g., width, of the gap 28. Data is collected from three or more gap sensors positioned at each of the turbine shell arm standard supports 14. The data collected from the multiple sensors is correlated by time.

Initial readings from the three probes are used to establish the baseline slope of the shell arm support. This baseline slope serves as the basis for all future measurements so that both the magnitude and direction of slope change can be continuously monitored. Thereafter, shell arm support planar slope changes are indicative of the deflection of the casing. Abrupt changes in shell arm support planar slope indicate the presence of changing piping forces, moments and torques on the casing.

The deflection of the casing due to piping system load changes the reaction force at each turbine support and manifests itself as a change in shell arm slope at each arm. Shell arm support slope changes are detected by measuring changes in the gaps at each of the three sensors. The data coupled with the known spacings between probes provides sufficient data to define changes in the slope of the shell arms. Changes in the shell arm support slope indicate both the magnitude and direction of shell arm deflection and hence the magnitude and direction of turbine casing deflection due to forces, moments and torques applied by the piping system.

Figure 4:
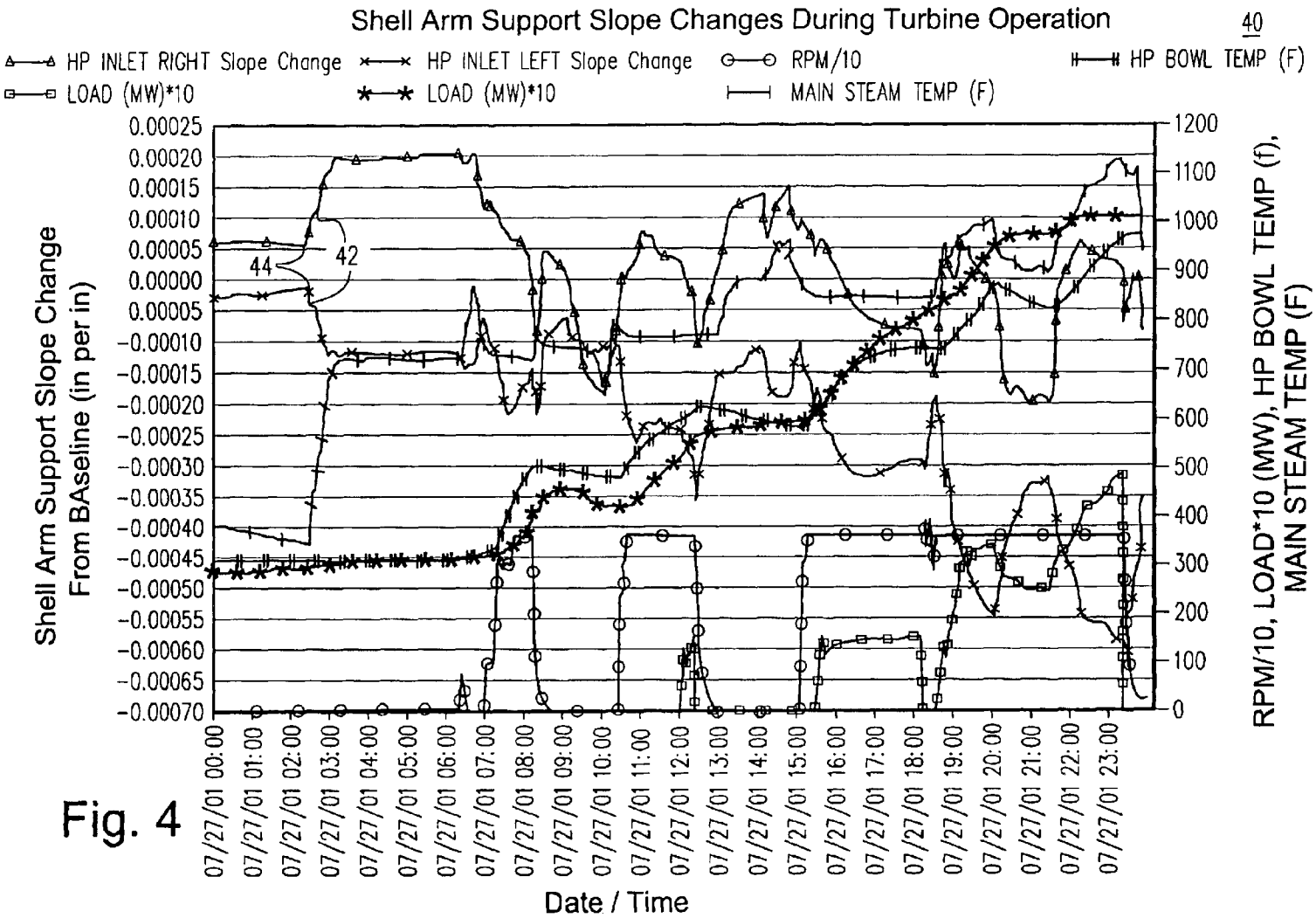
FIG. 4 is a chart of exemplary shell arm deflection data collected during operation of a turbine and relevant to the casing of the turbine.

FIG. 4 is a chart 40 showing exemplary data collected from a turbine over time and while the turbine is in operation. The data may be collected periodically, e.g. every second or every minute, and stored in the data acquisition unit 32. A processor in the data acquisition unit may continuously analyze the data to determine changes in the planar slope of each shell arm support. By monitoring these slope changes during the operation of the turbine, changes in the deflection of the casing can be detected. Changes in the deflection of the casing may be indicative of excessive pipe loads being applied to the turbine casing.

The chart 40 includes line graphs 42 of the changes in slope for the two HP Inlet shell arm supports as well as other startup parameters such as Speed (RPM), Load (MW), Inlet Steam Temperature (F), HP Bowl Temperature (F), and Axial Shell Expansion (mils). The line graph shows the change in slope verses time compared to an initial baseline value. Rapid changes in the slopes, such as at points 44 where the slope of the right arm slope increases while the slope of the left arm decreases shows the piping system imparting a twisting force on the casing. The changes in the slope of the gap plane are a good indicator that pipe connection loads have changed, especially when other turbine conditions, e.g., Speed (RPM), Load (MW), Inlet Steam Temperature (F), HP Bowl Temperature (F), and Axial Shell Expansion (mils).

Shell arm slope changes may vary for reasons other than deflection of the casing due to piping loads. Changes in shell arm slope can be caused by: (i) changes in interconnecting pipe forces, moments, and torques, (ii) steam flow reaction forces on the shell due to steam flowing through the turbine, (iii) condenser vacuum loading force changes on the turbine shell, (iv) shell thermal distortion due to changes in the temperature of the turbine and ambient temperature changes, (v) shell arm softening due to Modulus of Elasticity reductions as the metal temperature of the arm rise, and (vi) axial expansion effects. To quantify the casing deflection primarily attributable to loads applied by the interconnecting pipes, the effects of the other factors must be removed from the gap data. A procedure for isolating the effects of factors other than pipe loads is proposed below, but as of yet has not been reduced to practice.

Steam reaction forces on the shell are proportional to steam flow through the turbine. The direction of steam reaction forces are also predictable. A function, e.g., a linear function, can model the steam reaction forces as a response to a function of steam flow volume through the turbine. This function can be applied to estimate the steam reaction forces on the shell. Furthermore, it is assumed that the casing shell arm supports will deform in a linear fashion as the steam reaction forces increase or decrease. By assuming that the steam reaction forces are linear with steam flow, their effect on shell arm slope can be calculated and subtracted from the raw data set of the gap measuring probe 30.

Condenser vacuum loading forces are proportional to vacuum load, which can also be measured on a continuous basis. The effect of vacuum loading forces on the shell arm slope can be determined and subtracted from the raw data set of probes 30. Shell thermal distortion and axial expansion effects on shell arm slope are calculated using outer shell temperature data which is continuously collected. Computer modeling of the shell allows the shell thermal distortion effects on shell arm slope to be subtracted from the raw data set of the probes 30.

Shell arm thermal softening effects are accounted for by using thermocouple data from the shell arms and established material properties tables to predict the deflection of the shell arm due to arm softening. The axial expansion of the turbine shell is monitored continuously. Using this data and shell computer models, the effects of axial expansion on shell arm slope can be calculated and subtracted from the raw data set leaving only slope changes as a result of piping forces moments and torques. Using computer models, transfer functions are developed to quantify the amount of force required to produce varying levels of shell arm slope change. Use of computer turbine shell models and outer shell temperature data collected on a continuous basis enables thermal distortion effects to be subtracted out of the data set.

Use of outer shell temperature data collected on a continuous basis with thermocouples and computer models of the turbine shell allows the effects of shell thermal distortion on shell arm slope to be subtracted out of the data set. Use of exhaust pressure data collected on a continuous basis with and computer models of the turbine shell allows the effects of vacuum load application on shell arm slope to be subtracted out of the data set. Use of shell arm and shell arm key temperature data collected on a continuous basis with thermocouples allows shell arm thermal softening predictions (due to Modulus Of Elasticity changes) to be made which can be subtracted out of the data set.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method to monitor distortions in a turbine casing having at least a shell arm portion, a support key, and a shell standard support comprising:

a. positioning a plurality of sensitive gap sensors on a surface of the shell standard support which supports the shell portion;

b. each gap sensor monitoring a gap between the shell arm portion and the shell standard support, wherein the gap is between the surface of the shell arm portion and an opposing surface of the shell standard support;

c. collecting data regarding the gap dimension for a period of time;

d. determining changes in planar shell arm slope over the period of time based on the collected data, wherein the shell arm slope is indicative of the data collected from the gap sensors at a certain period of time, and e. reporting changes to the slope of the gap over the certain period of time.

2. A method as in claim 1 further comprising identifying rapid changes in the slope as indicating a substantial change in pipe loading on the casing.

3. A method as in claim 1 wherein each gap sensor is a non-contact capacitive probe.

4. A method as in claim 1 wherein there are at least three gap sensors in a gap between a shell arm support and a shell standard support, wherein the shell arm portion is attached to the shell and the shell standard support is mounted to a turbine foundation.

5. A method as in claim 4 wherein the gap sensors are positioned on opposite sides of the key between the shell arm support and the shell standard support.

6. A method as in claim 1 wherein the shell arm slope change is a planar slope change of the shell arm.

7. A method as in claim 1 wherein the shell arm slope change is a slope change of a plane between a shell arm support and a shell standard support of the turbine casing.

8. A method as in claim 1 wherein the plurality of gap sensors is at least three non-contact probes, and the shell arm support slope change is the slope change of a plane defined by the three gap sensors.

9. A method as in claim 8 wherein the three probes are positioned around the key between a shell arm support and a shell standard support.

10. A method to monitor distortions in a turbine casing having at least a shell arm support, key, and shell standard support, said method comprising:

a. positioning at least three gap sensors on a surface of the shell standard support and below the shell arm support;

b. each gap sensor monitoring a gap between the shell arm support and the shell standard support;

c. collecting data regarding a change in shell arm slope for a period of time;

d. detecting changes in the shell arm support slope of the gap over the certain period of time, and e. determining whether the casing has been excessively deflected based on the changes in the slope of the shell arm support.

11. A method as in claim 10 further comprising identifying a rapid change in the slope as an indication of a substantial change in pipe loading on the casing.

12. A method as in claim 10 wherein each gap sensor is a non-contact probe.

13. A method as in claim 10 wherein the gap sensors are positioned on opposite sides of the key between the shell arm support and the shell standard support.

14. A method as in claim 10 wherein the change in shell arm slope is a slope change of a plane within the gap.

15. A method as in claim 10 wherein the slope of the shell arm support is a slope change of a plane defined by the gap.

16. An apparatus to monitor deflections in a turbine casing having at least a shell arm support, key, and shell standard support, said apparatus comprising:

a plurality of gap sensors arranged on a shell standard support surface, wherein the support surface supports the key and turbine shell;

each of said plurality of gap sensors generating a gap signal indicative of a gap dimension between the standard support surface and said shell arm support; and a controller receiving the gap signal from each of the plurality of gap sensors, wherein said controller generates output data regarding the gap dimension.

17. An apparatus as in claim 16 wherein the plurality of gap sensors are each a non-contact probe.

18. An apparatus as in claim 16 wherein the gap sensors are positioned on opposite sides of the key between the standard shell support and said shell arm support.

19. An apparatus as in claim 16 wherein the output data includes information identifying change in shell arm planar slope.

* * * * *